US005273101A

United States Patent [19]

Lillquist et al.

[11] Patent Number: 5,273,101

[45] Date of Patent: Dec. 28, 1993

[54] METHOD AND APPARATUS FOR CASTING AN ARC MELTED METALLIC MATERIAL IN INGOT FORM

[75] Inventors: Robert D. Lillquist, Schenectady, N.Y.; Gordon B. Hunter, Loveland; Richard G. Menzies, Wyoming, both of Ohio

[73] Assignee: General Electric Company, Cincinnati, Ohio

[21] Appl. No.: 710,616

[22] Filed: Jun. 5, 1991

[51] Int. Cl.[5] ..... B22D 11/16; B22D 27/02

[52] U.S. Cl. ..... 164/452; 164/470; 164/495

[58] Field of Search ..... 164/452, 494, 495, 469, 164/470, 154, 506, 508

[56] References Cited

U.S. PATENT DOCUMENTS

| | | | |
|---|---|---|---|
| 4,656,331 | 4/1987 | Lillquist et al. | 219/121.47 |
| 4,687,344 | 8/1987 | Lillquist | 374/124 |
| 4,838,340 | 6/1989 | Entrekin et al. | 164/469 |
| 4,884,625 | 12/1989 | Paton et al. | 164/495 |

FOREIGN PATENT DOCUMENTS 2254642 11/1972 Fed. Rep. of Germany .

*Primary Examiner*—Kuang Y. Lin

*Attorney, Agent, or Firm*—Jerome C. Squillaro; Carmen Santa Maria

[57] ABSTRACT

A method and apparatus for casting a molten metallic material in ingot form are provided wherein the molten metallic material is transported to the ingot mold and an upper surface temperature and temperature distribution of the molten metal pool in the casting mold are measured by an imaging radiometer which is disposed external to an inert gas filled chamber enclosing the ingot mold, and is disposed to view the ingot pool surface through a sight port. At least one plasma arc torch is employed to direct an arc at the ingot pool surface, the intensity of which is selectively modulated and the impingement of the arc is simultaneously selectively positioned in order to maintain a desired preselected mold pool surface temperature and temperature distribution thereby yielding a preselected metallurgical structure in the solidified ingot. The imaging radiometer may provide a video signal as an output, and may be connected to a video analyzer and video monitor which are used to provide an image of the surface temperature and temperature distribution, enabling an operator to control the plasma arc torch in performing the ingot casting method.

20 Claims, 2 Drawing Sheets

METHOD AND APPARATUS FOR CASTING AN ARC MELTED METALLIC MATERIAL IN INGOT FORM

BACKGROUND OF THE INVENTION

The present invention relates to a method and an apparatus employed to control the solidification of metal alloys, specifically Ni-base superalloys, in a plasma arc melting (PAM) and ingot casting operation.

For certain applications, particularly aerospace applications wherein nickel-base superalloy ingots are commonly employed, the ingot structure desirable is one free from structural imperfections. As used in this sense, the term imperfection includes but is not limited to laps, cold shuts, porosity, non-uniform grain size, and chemical segregation resulting in cracking or non-uniform mechanical properties. PAM processes provide a means to control the ingot structure and to minimize or eliminate imperfections by controlling heat input to the solidifying ingot. A further desired feature of such ingots is that they be free of oxide inclusions larger than the grain size of the finished component, as such inclusions adversely affect low cycle fatigue properties of the component. It is possible in some PAM processes to float oxide inclusions out of the molten metal prior to the inclusions entering the ingot mold with the molten metal.

Three basic methods are generally employed in PAM processes for producing metal alloys, namely drip melting, nonconsumable electrode melting and hearth melting. Generally, the end product formed in these processes is an ingot solidified from the molten metal in a casting mold. The drip melting process employs a feed stock electrode, which is melted using arcs, and the molten metal droplets fall on the upper surface of the ingot being cast. The nonconsumable electrode melting process employs feed stock which is introduced either directly into the molten metal in the casting mold or into a rotating skull crucible for melting and batch pouring onto the upper surface of the ingot. By comparison, the hearth-melting process employs a feedstock melted by plasma arcs wherein the molten metal is collected in a horizontal trough, or hearth, and is maintained as a liquid in the hearth by use of additional plasma arcs directed onto the surface of the hearth. This molten metal is then conveyed to a pour notch disposed over the ingot mold. It is known in the art in all of these processes that arcs may further be used to heat the upper surface of the metal in the mold to influence the solidification and cooling of the solidifying ingot. Proper cooling of the ingot is required in order to produce the desired alloy solidification structure and surface condition of the ingot.

Electron beam melting (EBM) processes are similar to PAM processes except that EBM processes utilize electron beams rather than plasma arcs and they are conducted under a vacuum instead of an inert gas. Methods for production of uniform fine grain ingots by the EBM drip process have previously been proposed. As an example, one approach employs a continuous casting method in which the upper surface temperature of the ingot is maintained below the solidus temperature of the alloy but still above a temperature which promotes metallurgical bonding between the molten metal droplets and the ingot surface. In this process, no means are employed for measuring the ingot surface temperature for use in controlling the drip rate and deposition pattern. Also, in this process, the application of heat input to the upper ingot surface has generally been regarded as undesirable, possibly because of the absence of means for taking direct surface temperature measurements for controlling drip rate and deposition pattern. The result of the use of temperatures at or below the alloy solidus is that the product is not a true ingot casting, but rather is an accumulation of metallurgically bonded solidified droplets which form pores and entrap contaminants, such as oxide inclusions, in the structure.

EBM hearth processes have heretofore also been proposed for the purpose of producing ingots with desired internal structures together with acceptable surface conditions, although the processes have not met with complete success. Such prior processes generally involved visual observation of the molten pool surface and temperature measurements of a discrete location or locations made by a two-color pyrometer, while an operator used such information in attempting to manually control the electron beam power and impingement pattern in order to produce a desired pool surface temperature with the object of yielding the desired ingot solidification structure. To date, this method of process monitoring has proved to be inadequate in attaining the required accuracy in controlling the beam power and impingement pattern to produce the desired ingot solidification structures.

In one previous approach to ingot casting by an EBM or PAM hearth process, the objective of the process has been to maintain the pool surface temperature at the center of the mold at a temperature slightly below the liquidus temperature of the alloy, while maintaining the temperature at the edges of the pool slightly above the alloy liquidus temperature. The former temperature was selected in order to create solid crystallites to act as 'seeds' from which the ingot would solidify, and the latter temperature was selected in order to prevent cold shuts or laps from forming at the edges of the ingot. This process has the advantage that the central pool temperatures can be monitored visually because the formation of the crystallites provides a visual indication that the temperature is in fact below the alloy liquidus. As discussed above, however, visual observation and manual control of the pool surface temperature do not provide the degree of control accuracy which is required to produce ingots having the desired solidification structures.

This method has a further disadvantage in that the temperature gradients produced on the ingot pool surface in practicing this method also give rise to unacceptably rapid fluid convection in the pool. The rapid pool convection has the potential to take undesirable oxide inclusions from the surface and entrap them in the solidifying ingot. Additionally, the deliberate temperature gradient produced on the surface in this method results in a non-uniform microstructure in the solidified ingot. One further disadvantage which has been noted in association with this approach is that, when the pool temperature employed is below the liquidus, a very shallow ingot pool is evidenced, and the solidification structures produced are exceptionally sensitive to small changes in the energy applied in the form of beam or arc heating, making the process even more difficult to properly execute and control.

While the relatively narrow area of heat input characteristic of electron beams makes the precise spatial control of heat input possible, it also makes it difficult to maintain large areas of the molten metal surface at a uniform temperature. In addition, the high vacuum necessary for the use of electron beams restricts heat extraction and selectively vaporizes alloying elements. With an inert atmosphere in PAM processes, greater heat extraction is possible, perhaps creating a shallower pool to produce a satisfactory solidification structure. The inert gas atmosphere also reduces vaporization of alloying elements, making it easier to produce a desired ingot composition. By using arcs, PAM also has a broader heat input distribution than is characteristic of EBM, allowing easier maintenance of large areas at uniform temperatures.

It is therefore a principal object of the present invention to provide an apparatus for casting a molten metallic material in the form of an ingot wherein the solidification is accurately controlled to produce a predetermined desired solidification structure in the ingot.

It is another object of the present invention to employ an imaging radiometer in combination with a PAM hearth or drip melting apparatus, wherein the imaging radiometer is positioned to measure the upper molten pool surface temperature and provide an image related to temperature distribution across the surface.

It is another object of the present invention to provide a method for casting a molten metallic material in the form of an ingot, wherein the method includes accurately measuring and monitoring the upper molten pool surface temperature, and directing an arc at the upper molten pool surface to maintain a substantially uniform temperature across substantially the entire upper molten pool surface.

It is a further object of the present invention to provide a method for casting a molten metallic material in ingot form, wherein the upper molten pool surface temperature is measured by an imaging radiometer and an image related to temperature distribution across the surface is produced by the imaging radiometer, the image being employed to control the intensity and areas of impingement of arcs directed toward the upper molten pool surface in order to maintain the substantially uniform temperature across the molten pool surface.

SUMMARY OF THE INVENTION

The above and other objects of the present invention are accomplished by providing an apparatus for casting a molten metallic material in ingot form by way of a plasma arc melting (PAM) hearth or drip process, wherein an imaging radiometer is employed to measure the upper surface temperature of a molten pool in a casting mold, to provide an image related to the temperature distribution across the surface or to provide signals representative of this temperature distribution. The apparatus is equipped with a plasma arc torch or torches which are used to direct an arc or arcs at the molten pool surface in order to achieve or maintain a predetermined molten pool surface temperature distribution, this temperature distribution being monitored and verified by the imaging radiometer.

In the method according to the present invention, a PAM hearth or drip process designed to cast molten metallic material into ingot form in a mold is provided, the method including the steps of measuring the upper surface temperature distribution of the molten pool, and selectively positioning and modulating the intensity of an arc directed at the molten pool surface in order to maintain a desired preselected temperature distribution on the molten pool surface. Important aspects of the method include maintaining a substantially uniform temperature distribution across substantially the entire molten pool surface. That temperature preferably is maintained slightly above the alloy liquidus temperature of the metallic material being cast into ingot form.

Further features of the apparatus and method of the present invention include the use of a blackbody reference radiation source disposed adjacent to the molten pool surface in the mold to enable a periodic check of the calibration accuracy of the imaging radiometer and measurement of sight port transmission losses during furnace operation. Additionally, the plasma arc torch control system employed to aim the arc or arcs at desired areas or regions of the molten pool surface and to modulate the intensity of the arc or arcs, is operatively connected to an output of the imaging radiometer, wherein a video display of the detected temperature distribution may be used to assist an operator in directing arcs at particular regions of the molten pool surface in order to maintain the preselected surface temperature profile. Alternatively, the coupling of the output of the imaging radiometer to the plasma arc torch control may be operatively connected with means for receiving the output signals and means for automatically controlling the aiming and intensity of the arcs.

BRIEF DESCRIPTION OF THE DRAWINGS

These and other features of the present invention and the attendant advantages will be readily apparent to those having ordinary skill in the art and the invention will be more easily understood from the following detailed description of the preferred embodiments of the present invention, taken in conjunction with the accompanying drawings wherein like reference characters represent like parts throughout the several views.

DETAILED DESCRIPTION OF THE INVENTION

Figure 1:
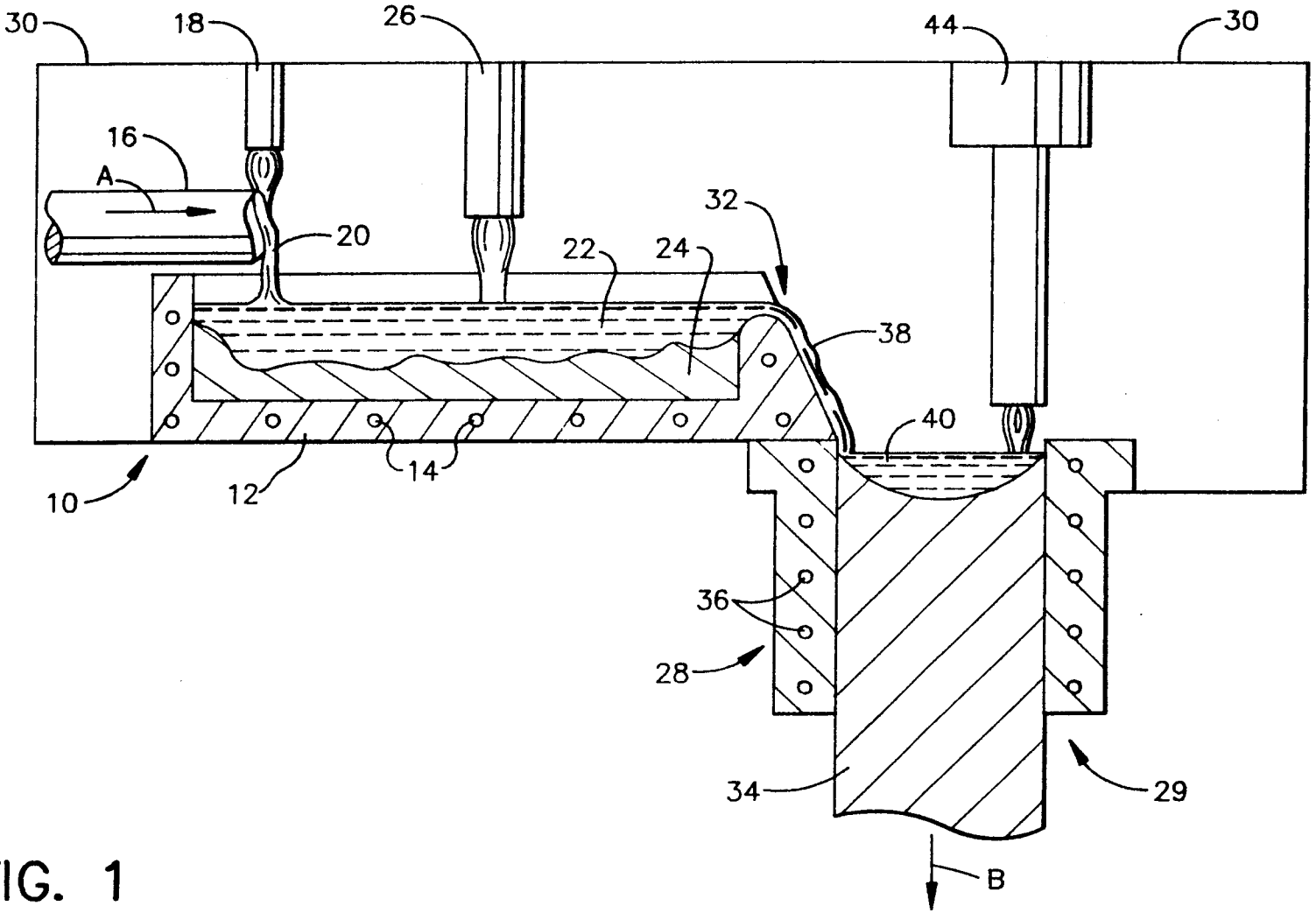
FIG. 1 is a schematic sectional view illustrating a representative embodiment of a PAM hearth apparatus according to the present invention.

Referring initially to FIG. 1, a representative embodiment of a PAM hearth apparatus suitable for practicing the present invention is schematically illustrated. A hearth 10 comprises hearth bed 12 containing cooling pipes 14 through which water or another cooling liquid may be circulated. The hearth bed in this embodiment comprises a means for transporting the molten metallic material to an ingot mold, as will be described in more detail later in the specification. At the inlet end of the hearth, a bar 16 of metal-alloy to be refined and cast into an ingot is moved continuously toward the hearth in a known manner as indicated by arrow A. The raw material supplied to the hearth 10 may alternatively be in particulate form such as small fragments or compacted briquettes of the material to be cast into an ingot.

A first directionally controllable energy input device 18, preferably a conventional plasma arc torch 18, is mounted above the hearth and is used to heat and melt the end of the metal alloy bar 16 extending over the hearth bed 12, such that a stream of molten metallic material 20 flows into the hearth bed to create a pool 22 of molten material. The purpose of providing the hearth bed 12 with cooling pipes 14, through which cooling liquid flows, is to form a solid skull 24 of the material on the inner surface of the hearth bed 12 to protect the bed from degradation by the molten material and to minimize the possibility that the molten material will pick up contaminants from the hearth bed.

Additional directionally controllable energy input devices, represented by plasma arc torch 26, may be employed to maintain the material in a molten state and at a desired preselected temperature for supplying the material to the ingot mold 28.

It is to be noted that because plasma arc torches 18, 26 are used as the energy source for melting the alloy bar 16 and maintaining a molten pool, the hearth bed 12 and mold 28 depicted in FIG. 1 are enclosed in an inert gas filled housing 30, represented schematically in FIG. 1, in a manner well known in the art.

At the end of the hearth opposite that where the metal alloy bar 16 is melted, a pouring lip 32 is provided in the form of an opening in the hearth wall. The pouring lip 32 permits the molten metallic material to flow out of the hearth into ingot mold 28, in which the metallic material is solidified into an ingot 34 as a result of radiant cooling from the surface of the molten metal as well as by convection through the inert gas and by conduction through the ingot mold 28, which preferably has cooling tubes 36 carrying a cooling fluid such as water to cool the mold. The ingot 34 is withdrawn downwardly through an opening 29 in the bottom of mold 28 in the direction of arrow B in a known manner, preferably at a continuous substantially uniform rate. This withdrawal rate is also preferably about the same rate at which the solidification front of the ingot advances upwardly toward the surface of the mold.

As indicated previously, the temperature of the molten metallic material leaving the hearth to enter the mold is preferably superheated to a temperature above the alloy liquidus temperature, for example, between 30° C. and 100° C. above the liquidus temperature. A pyrometer may preferably be provided to monitor the temperature of the material at the pour lip 32, in a manner known in the art. This temperature reading may be employed to control the plasma arc torches 18, 26, as necessary, either manually or by way of an automatic control system, for example, operatively connected to the pyrometer and the controls for the plasma arc torches.

The molten metallic material 38 supplied from the pouring lip 32 to the mold forms a pool 40 of molten metal at the top of the mold. The portion adjacent to the inner surface of the mold has a tendency to solidify more rapidly than the center portion of the pool because of the cooling tubes 36 in the adjacent mold. One or more directionally controllable energy input devices are provided, depicted schematically as plasma arc torch 44, which is employed to control the surface temperature of the pool 40 in order to control the solidification of the ingot such that a desired preselected solidification structure is produced in the ingot.

Figure 2:
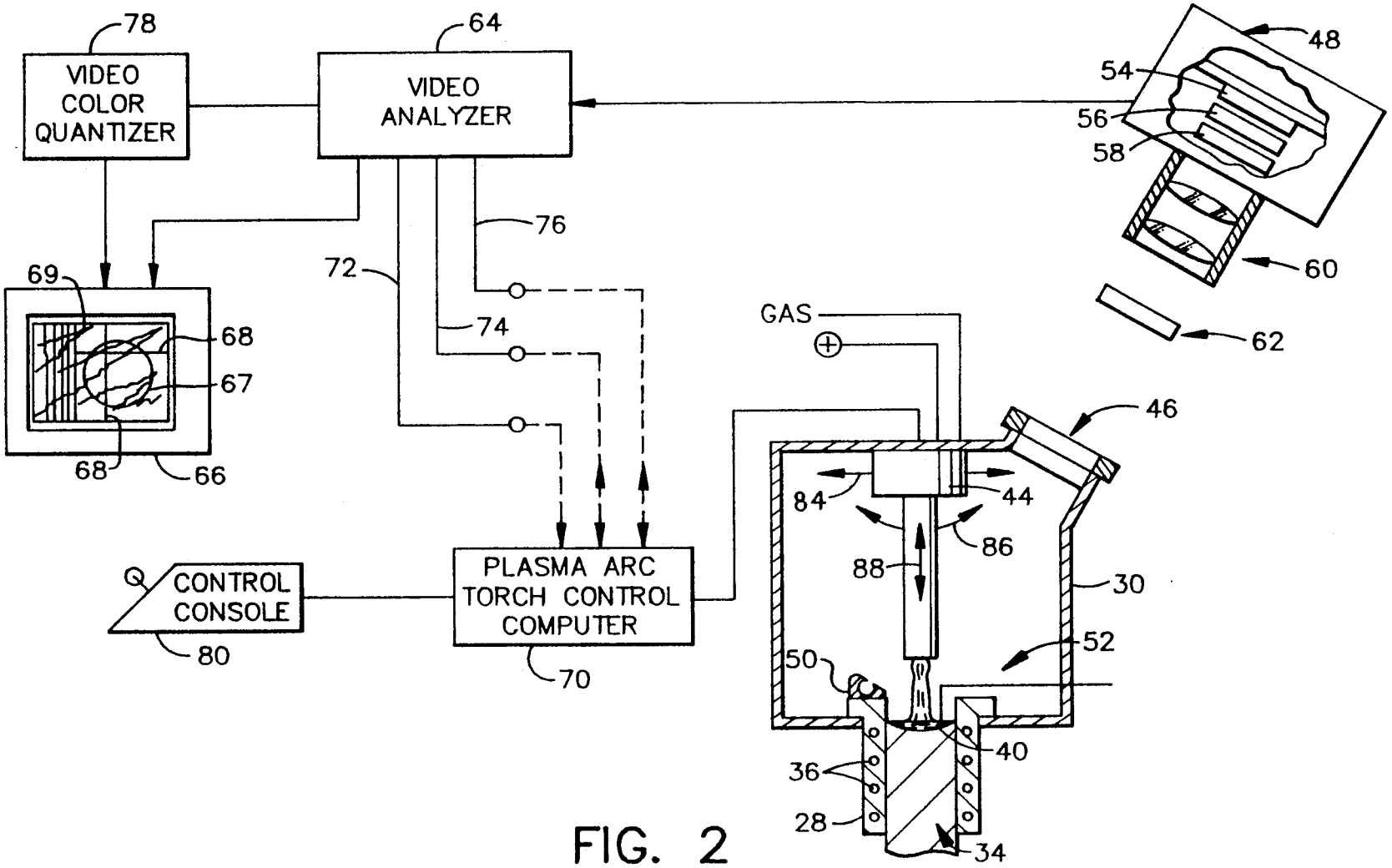
FIG. 2 is a schematic view of the mold section of a PAM furnace, an imaging radiometer, and associated components in accordance with a preferred embodiment of the present invention.

To this point, the PAM process and apparatus described are of a substantially conventional nature. Referring now to FIG. 2, the mold section of the PAM furnace of FIG. 1 is shown and described in further detail. The inert gas filled housing 30 encloses this section as also shown in FIG. 1. One plasma arc torch 44 is disposed on the inert gas filled housing or chamber, and is adapted to direct arcs at the surface of the pool 40 of molten metallic material.

At the top of the inert gas filled chamber 30, a sight port 46 is provided in order to permit imaging radiometer 48 to view the upper surface of the metal in the ingot mold 28. Sight ports have heretofore been employed in PAM furnaces and preferably contain quartz, sapphire, or similar heat resistant window materials. The imaging radiometer 48, details of which will be discussed later, and imaging radiometer sensor-based melt temperature control are preferably of the type disclosed in U.S. Pat. No. 4,656,331, assigned to the assignee of the present invention, the subject matter of which is hereby incorporated by reference. The imaging radiometer 48 is disposed outside the sight port, and preferably in a position such that the sightpath of the radiometer intercepts the surface of the melt pool 40 at nearly a normal incidence, in order to limit the effects of reflections and other spurious sources of light.

Located inside the chamber 30, adjacent the ingot mold 28 and within the field of view of radiometer 48, is a blackbody reference source 50. A Mikron Instruments Model Blackbody can be modified for operation inside an operating PAM hearth furnace, and would be suitable for use as radiation reference source 50. The blackbody provides a means for periodically checking the calibration accuracy of imaging radiometer 48 and provides the imaging radiometer with means by which changes in the sight port 46 window transmittance may be detected and compensated for during furnace operation. Such changes in transmittance can be caused by condensation or other loss mechanisms. A dip thermocouple 52 is also preferably disposed in a position where it can be employed to provide spot calibrations of the alloy emissivity, the thermocouple 52 being shown in FIG. 2 at a lowered operating position. Because there is a risk that the thermocouple will contaminate the alloy, the calibration made by the thermocouple is preferably only performed at the beginning or at the conclusion of a melt processing run or in conjunction with the collecting of a sample. In any event, the use of the imaging radiometer obviates the need for more frequent use of the dip thermocouple, as a continuous measurement of temperature across the entire surface is provided.

The temperature sensing means 48, in the depicted preferred embodiment in FIG. 2 takes the form of an imaging infrared radiometer. The image of the pool surface 40 may be formed using a single detector and mechanical scanning means or hybrid configurations such as a linear array of detectors and mechanical scanning means or a two dimensioned electronically scanned array of detectors. In addition, a variety of lenses 60 may be used for selecting different fields of view of the mold and surrounding objects. A wide angle lens would be used, for example, to image the pool surface 40, blackbody reference calibration source 50 and dip thermocouple 52 simultaneously when calibrating the system. A telephoto lens may be used to selectively enlarge one area of particular interest.

In general, the wavelength response of the imaging radiometer and its associated optics, filters (56, 58, 62) and sight port 46 in the preferred embodiment is tailored by choice of components to exclude wavelengths less than approximately 3 microns to minimize plasma background radiation interference. one such preferred sensor system was disclosed in U.S. Pat. No. 4,656,331, assigned to the assignee of the present invention. Cryogenically cooled infrared photon detector materials, such as indium antimonide, platinum silicide or various doping of mercury-cadmium telluride are preferred for detector 54 for their high sensitivity and speed. However, the inventors recognize that less sensitive detector materials, such as pyroelectric crystals, could also be used in some implementations of the present invention provided that the spectral response requirements are met. Spectral band filter 56 preferably takes the form of a long-pass filter to exclude wavelengths less than approximately 3 microns. Neutral density filter 58 is used to reduce the intensity of the sensed radiation to levels within the capability of the imaging radiometer. A rotatable linear polarizing filter 46 may also be inserted and adjusted to minimize the measurement errors due to reflections from the pool surface 40.

In situations where arc plasma background radiation intensity is small relative to the intensity of the thermal radiation emitted by the pool surface, use of other wavelength regions can be advantageous. Such situations arise when, for example, the arc and its reflected image are not in the location of the melt pool where surface temperatures are being monitored by the imaging radiometer. Reduced arc length and use of particular gases, such as helium and hydrogen can contribute to reduced arc radiation intensity in portions of the visible and near-infrared wavelengths as well as the previously mentioned generally low intensities found in the infrared wavelengths longer than 3 microns. In these situations, detectors and accessory optics giving effective imaging radiometer wavelength response in portions of the 600 to 1100 nanometer band will comprise a satisfactory thermal sensing means of the present invention. One such system, disclosed in U.S. Pat. No. 4,687,344 assigned to the assignee of the present invention, preferrably uses a silicon Charge Injection Device planar detector array as detection means 54 and signal processing means (64, 78) and filtering means (56, 58) arranged as shown in the thermal sensing means of the present invention.

A video signal is output from the imaging radiometer 48, which is focused on the surface of the melt pool 40, the signal corresponding to the detected emissivity information. The signal, which may conform to either U.S. (e.g. EIA RS-170) or European standard, may be directly displayed or may be processed further. As depicted in FIG. 2, the video signal, instead of being directly displayed, is fed to a video analyzer 64. The video analyzer preferably provides a continuous graphical signal intensity, i.e., object temperature and temperature distribution, display or overlay on a video monitor 66. The video analyzer 64 must be calibrated and adjusted where necessary to establish a direct correspondence between the target object (melt pool 40) radiant intensity, as measured by the imaging radiometer, and the graphical display and output signals of the video analyzer. Video monitor 66 preferably displays the temperature and the temperature distribution by using a full-field-of-view image 67 showing in gray tone or pseudocolor the distribution across the entire surface of the melt or mold pool 40, and, in addition, by displaying a graphical profile 69 of the actual temperature measured.

A video analyzer which is particularly suitable for use in the present invention is the Model 321 Video Analyzer made by Colorado Video of Boulder, Colo. The video analyzer also preferably provides a manual and external means for directing a pair of cursors 68, one horizontal and one vertical, over the image displayed on the monitor 66 to pinpoint and extract the intensity (measured temperature) of any particular point or pixel in the image displayed on the monitor, and for supplying a voltage which is proportional to the extracted intensity to one or more predetermined external devices. As depicted in FIG. 2, a plasma arc torch control computer 70 is provided, and is connected to the video analyzer 64, receiving the voltage signal related to the detected pixel intensity through video analyzer output channel 72. The video analyzer 64 preferably has additional input/output channels, represented by channel lines 74, 76 in FIG. 2 which are adapted to provide cursor address signals to external devices such as computer 70, and to receive cursor positioning signals from an external device, in this instance, also computer 70.

A video color quantizer 78 may be provided to further process the video signal, which may be passed through the video analyzer in the configuration depicted in FIG. 2. The video color quantizer is used to display discrete, user-set, gray scale intensity levels as step-tone colors on the video monitor. The gray-tone display of the video analyzer generally provides improved definition of fine spatial details in the target object, whereas the pseudocolor intensity-mapped display generated by the video color quantizer is useful when performing control adjustments in the plasma arc torch parameters to bring larger areas of the melt pool surface to a common temperature, which would be indicated in the display by a single solid color. A commercially available video color quantizer which is suitable for use in the present invention is the Colorado Video Model 606.

An operator's control console 80 is provided for use in controlling the plasma arc torch parameters, e.g., power or intensity, inert gas flow and arc impingement pattern in maintaining the predetermined. temperature profile in the surface of the melt pool 40. If the PAM furnace is intended to operate on a strictly automated basis, the control console may be omitted from the apparatus. The control console 80 is linked with the plasma arc torch control computer which relays commands from the control console to the torch 44. An operator would manipulate the controls to generate commands to modulate the arc power or intensity as well as to adjust the inert gas flow and arc impingement pattern on the mold pool surface.

The arc impingement pattern can be directed through means that are well known to those ordinarily skilled in the pertinent art. Examples of such means are modulation of the inert gas flow, magnetic deflection of the arc and mechanical adjustment of the torch position. Mechanical torch position adjustment is depicted in FIG. 2 as traversing means 84, tilting means 86, and extension means 88.

The operation of the apparatus in practicing the method of the present invention for casting molten metallic material in the form of an ingot will now be addressed. The method generally involves heating, melting and transporting the metallic material to a mold means or ingot mold 28, having an opening in the bottom thereof for withdrawing the ingot, the method further including measuring the surface temperature and temperature distribution of the mold pool 40 using an imaging radiometer, controlling the surface temperature distribution to achieve a desired predetermined temperature and distribution, the control being effected by selective positioning of and selective modulation of the intensity of at least one plasma arc torch positioned to direct an arc at the mold pool surface, and cooling and removing the solidified ingot from the mold. The desired predetermined surface temperature and temperature distribution are selected to produce a desired, preselected metallurgical structure in the solidified ingot.

The heating, melting and transporting of the metallic material are generally known in the art of PAM hearth melting processes, and for that matter, in PAM drip melting processes, which may also be employed in practicing the present invention. While not the preferred embodiment, the use of nonconsumable electrode electric arc processes in inert gas filled or vacuum chambers may also be employed in practicing the present invention.

The present invention focuses on the use of an imaging radiometer 48 and its associated components described with respect to FIG. 2 in controlling the temperature of the melt pool surface of the solidifying ingot in order to obtain a desired preselected metallurgical structure in the alloy ingot. The method for casting a molten metallic material in accordance with a preferred embodiment of the present invention is primarily directed to producing ingots of a nickel-base superalloy, however, the method may also be practiced with other metallic materials, for example, titanium-base alloys, zirconium-base alloys, niobium-base alloys, cobalt-base alloys, iron-base alloys, and intermetallic aluminide alloys It is an important aspect of the method of the present invention to maintain a substantially uniform temperature across the surface of melt pool 40. It was recognized, in accordance with the present invention, that variations in temperature across the surface of the melt pool 40 in the ingot mold 28 not only result in variations in the solidification structure due to varying rates of solidification, but also caused excessive mold pool convection, which commonly leads to entrapment of oxides or other undesirable inclusions in the ingot. The oxides, which would generally tend to float on the mold pool surface, may be dragged below the surface and trapped when the pool is undergoing excessive convection.

A second important aspect of the present invention is that the temperature of the surface of the mold pool is desirably maintained above the liquidus temperature of the alloy being cast into ingot form. By maintaining the surface temperature above the alloy liquidus, as the molten metallic material and the solidification front of the solidifying ingot are much less sensitive to the energy or heat which is applied by the plasma arc torches in maintaining the substantially uniform surface temperature at temperatures above the liquidus.

While it is desired that a substantially uniform temperature distribution be maintained across the surface of the mold pool, it may be necessary to maintain a slightly higher temperature at the edges of the mold in order to reduce or eliminate the formation of cold shuts and to minimize or prevent tearing or cracking of the ingot surface that results when molten metal solidifies on the mold surface at the edge of the molten metal pool and prevents uniform withdrawal or extraction of the entire ingot during the casting process. The temperature in the central region of the mold pool is preferably maintained between zero and 10° C. above the alloy liquidus, although it would be possible to perform the method of the present invention using a mold pool temperature which is up to 30° C. higher than the alloy liquidus, and possibly even higher. The temperature at the edges of the mold pool is preferably maintained at a temperature no lower than that of the central region. Any temperature differential between the central region and the edges of the mold pool will, however, be sufficiently small in order to prevent excessive fluid convection.

The imaging radiometer 48 enables both of these important aspects to be achieved, as the imaging radiometer continuously monitors and produces an image of the entire mold pool surface, either in gray-tone or pseudocolor, on a monitor. Because the imaging radiometer detects the radiant emission from the alloy in the infrared range (greater than about 700 nanometers), there is no dependence on any visually determinable condition in measuring the surface temperature and the surface temperature distribution. The dependence in prior known processes on visual indications monitored by an operator required the mold pool temperatures employed in the process to generally be below the alloy liquidus temperature.

Automatic or manual control of the surface temperature distribution may be employed in the method of the present invention. In manually controlled PAM furnaces, the operator adjusts the operation parameters of the plasma arc torch 44, primarily modulation of the arc power and the torch motion pattern, using the video monitor 66 display in achieving and maintaining the desired melt pool temperature and substantially uniform temperature distribution.

The PAM furnace may alternatively be provided with the capability to automatically control the plasma arc torches 44 by way of computer 70 and real-time sensors (not shown). In an automatic operating mode, the imaging radiometer sensor system must have the capability to provide the plasma arc torch control hardware with a signal related to the detected intensity (temperature) at any selected location in the viewed scene. This can be accomplished by a system analogous to the signal 72 being supplied to computer 70 by the video analyzer 64, wherein the information detected by imaging radiometer 48 is automatically or selectively scanned to obtain the intensity signal at the location or locations in the viewed scene.

A nearly isothermal upper metal surface may thus be attained by adjusting the arc power or intensity and torch motion pattern in either the manual or automatic operating modes. In general, some heat input will always be necessary to compensate for the heat lost from the pool due to radiation and inert gas convection and conduction. The heat of fusion released at the ingot solidification front more than compensates for the heat conducted down the ingot. Heat lost by conduction through the water cooled ingot mold 28 may be compensated for by shifting the torch motion toward the edges of the melt pool 40, and as indicated previously, it may be desired to maintain a slightly higher temperature at the edges to minimize or prevent the formation of cold shuts and tearing or cracking of the ingot surface during the withdrawal or extraction of the ingot from the mold. A further consideration in controlling the surface temperature and distribution is that when a PAM hearth apparatus is employed, the molten metal pouring into the mold is generally at a higher temperature than the rest of the pool, and therefore less arc power will be required in that region.

In practicing the method of the present invention, the ingots produced have a more consistent and reproducible internal structure and surface quality. When a nickel-base alloy is employed in the process, examples of desired metallurgical structures which may be achieved include an equiaxed dendritic fine grain structure, a columnar dendritic grain structure, and a structure containing regions having an equiaxed dendritic fine grain structure and regions containing columnar dendritic grain structure. Preferred metallurgical structures which may be achieved using a titanium-base alloy include an equiaxed grain structure, a columnar grain structure, and a combination of regions of equiaxed and columnar grain structures.

It is to be recognized that other commercial or custom imaging radiometers could be employed in the apparatus and method of the present invention, provided that they operate in wavelength regions compatible with PAM processes and are compatible with sight port materials employed in an apparatus of this type. Commercially available imaging radiometers employing detectors sensitive to near-infrared wavelengths in the range of 900 to 3000 nanometers or portions thereof, while not preferred, could be employed in the present invention. Less sensitive detector materials such as pyroelectric crystals, or sensors employing charge-coupled devices, charge-injection devices, vidicon and other solid-state or vacuum tube television-like cameras operating in the visible wavelengths, may be employed in lieu of the preferred imaging radiometer described above provided that the spectral response requirements are met.

It is further recognized that the function performed by the Video Analyzer and Video Color Quantizer in the imaging radiometer sensor system could also be performed by a Video Frame Grabber (i.e., video analog to digital converter with internal digital frame storage capability) and appropriate software operating in a computer dedicated to video image processing or integrated with the process control computer.

The foregoing description includes various details and particular features according to the preferred embodiment of the present invention, however, it is to be understood that this is for illustrative purposes only. Various modifications and adaptations may become apparent to those of ordinary skill in the art without departing from the spirit and scope of the present invention. Accordingly, the scope of the present invention is to be determined by reference to the appended claims.

What is claimed is:

1. A method for casting a molten metallic material having a liquidus temperature in the form of an ingot comprising:

a. transporting said molten metallic material to a mold means for containing said ingot therein;

b. measuring emissivity indicative of an upper surface mold pool temperature of the molten metallic material and a temperature distribution of said upper surface mold pool across an entire surface thereof;

c. selectively positioning an impingement of an arc onto said mold pool surface and simultaneously selectively modulating intensity of said arc in order to maintain said measured entire mold pool surface temperature at a predetermined value above the liquidus temperature, and to maintain said measured surface temperature distribution at a predetermined surface temperature distribution, in order to produce a preselected metallurgical structure in said ingot;

d. solidifying said molten metallic material into ingot form by removing heat from said mold means; and e. gradually removing said solidified ingot from said mold means.

2. A method as defined in claim 1 wherein said predetermined surface temperature distribution comprises a substantially uniform temperature across said entire mold pool surface.

3. A method as defined in claim 1 wherein said predetermined surface temperature distribution comprises a substantially uniform temperature in a central portion of said mold pool surface, and a temperature higher than said uniform temperature at an edge of said mold pool, wherein a temperature difference between said central portion and said edge of said mold pool is sufficiently small to prevent excessive fluid convection in said mold pool.

4. A method as defined in claim 3 wherein said predetermined value of said surface temperature does not exceed 30° C. above the liquidus temperature.

5. A method as defined in claim 4 wherein said predetermined value of said surface temperature does not exceed 10° C. above the liquidus temperature.

6. A method as defined in claim 1 wherein said metallic material is a nickel-base alloy.

7. A method as defined in claim 6 wherein said preselected metallurgical structure is an equiaxed dendritic fine grain structure.

8. A method as defined in claim 6 wherein said preselected metallurgical structure is a columnar dendritic grain structure.

9. A method as defined in claim 6 wherein said preselected metallurgical structure is a structure containing equiaxed dendritic fine grain regions and columnar dendritic grain regions.

10. A method as defined in claim 1 wherein said metallic material is a titanium-base alloy.

11. A method as defined in claim 10 wherein said preselected metallurgical structure is an equiaxed grain structure.

12. A method as defined in claim 10 wherein said preselected metallurgical structure is a columnar grain structure.

13. A method as defined in claim 10 wherein said preselected metallurgical structure is a structure containing equiaxed grain regions and columnar grain regions.

14. A method as defined in claim 1 wherein said metallic material is a zirconium-based alloy.

15. A method as defined in claim 1 wherein said metallic material is a niobium-base alloy.

16. A method as defined in claim 1 wherein said metallic material is a cobalt-base alloy.

17. A method as defined in claim 1 wherein said metallic material is an iron-base alloy.

18. A method as defined in claim 1 wherein said metallic material is an intermetallic aluminide alloy.

19. A method for casting a molten metallic material in the form an ingot comprising:

a. transporting said molten metallic material to a mold means for containing said ingot therein;

b. measuring radiant emission from an upper surface mold pool to determine a temperature of the molten metallic material and a temperature distribution of said upper surface mold pool across an entire surface thereof;

c. Selectively positioning an impingement of an arc onto said mold pool surface and simultaneously selectively modulating intensity of said arc in order to maintain a surface temperature across said entire mold pool surface in excess of a liquidus temperature of said metallic material, and in order to maintain a substantially isothermal temperature distribution across said mold pool surface, said surface mold pool temperature and temperature distribution measured by an imaging radiometer being employed to control said selective positioning and said selective moldulating of said arc;

d. solidifying said molten material into ingot form by removing heat from said mold means; and e. gradually removing said solidified ingot from said mold means.

20. A method as defined in claim 19 further including the step of calibrating said imaging radiometer used for measuring radient emission against a blackbody reference source.

* * * * *